United States Patent [19]

Whitaker

[11] Patent Number: 4,764,040

[45] Date of Patent: Aug. 16, 1988

[54] SHOCK STABILIZED, TWIN COUNTER WEIGHT SHUTTLE DRIVE FOR RECIPROCABLY MOUNTED CARRIAGES

[75] Inventor: C. Gordon Whitaker, Mercer Island, Wash.

[73] Assignee: Mannesmann Tally Corporation, Kent, Wash.

[21] Appl. No.: 941,771

[22] Filed: Dec. 15, 1986

[51] Int. Cl.[4] ..... B41J 25/28; B41J 3/10

[52] U.S. Cl. ..... 400/320; 400/124; 101/93.04; 101/93.16

[58] Field of Search ..... 400/125, 320, 322, 120, 400/125.1, 124; 101/93.04, 93.09, 93.15, 93.16, 94

[56] References Cited

U.S. PATENT DOCUMENTS

| | | | |
|---|---|---|---|
| 4,088,867 | 5/1978 | Levene | 400/120 X |
| 4,127,334 | 11/1978 | Watanabe et al. | 400/124 |
| 4,203,679 | 5/1980 | Duerr et al. | 400/320 |
| 4,278,019 | 7/1981 | Meier | 101/93.04 |
| 4,387,642 | 6/1983 | Bringhurst et al. | 101/93.04 |
| 4,400,104 | 8/1983 | McCray et al. | 400/320 |
| 4,402,620 | 9/1983 | Kekas et al. | 400/121 |
| 4,446,789 | 5/1984 | Matsumoto et al. | 101/93.04 |
| 4,481,880 | 11/1984 | Kurosawa et al. | 101/93.04 |
| 4,543,884 | 10/1985 | Kikuchi et al. | 101/93.04 |
| 4,572,685 | 2/1986 | Matsumoto et al. | 400/320 |
| 4,573,363 | 3/1986 | Shin | 400/320 |
| 4,599,007 | 7/1986 | Khorsand | 400/320 X |

FOREIGN PATENT DOCUMENTS

| | | |
|---|---|---|
| 56-27358 | 3/1981 | Japan . |
| 58-12781 | 1/1983 | Japan . |
| 59-176063 | 10/1984 | Japan . |

OTHER PUBLICATIONS

Elements of Vibration Analysis, Leonard Meirovitch, McGraw-Hill ©1975, pp. 46–48.

Industrial Uses of Mechanical Vibrations, I. Gutman, Business Books Ltd. ©1968, pp. 62–65.

Vibration and Shock Test Fixture Design, B. J. Klee et al., Tustin Institute of Technology ©1971, pp. 2-1 and 2-2.

A section of a publication of Tustin Institute of Technology entitled "Types of Vibration Test Equipment" ©1963, revised 1976, pp. 10-1–10-3.

*Primary Examiner*—Paul T. Sewell
*Assistant Examiner*—James R. McDaniel
*Attorney, Agent, or Firm*—Christensen, O'Connor, Johnson & Kindness

[57] ABSTRACT

A twin counterweight, shuttle drive (11) for a reciprocably mounted dot matrix line printer carriage (13) that is shock stabilized to: (a) eliminate instability when the printer is bumped; and, (b) maintain the center point of the carriage peak-to-peak travel in the same position even when the printer is inclined, is disclosed. The shuttle drive (11) comprises a pair of equally sized and configured weight unbalanced gears (43) rotatably coupled together and secured to the mounted dot matrix line printer carriage (13). Rotation of the weight unbalanced gears (43) creates a drive force that shuttles the carriage (13). The gears (43) are positioned such that the drive force is aligned with the center of gravity of the carriage (13) and such that the centers of rotation of the gears (43) lie on a line that is perpendicular to the line of shuttle motion. The carriage (13) is shock stabilized by a journal (83) offset from the axis of rotation of a related gear (43) by a distance (A) equal to the desired peak amplitude of shuttle motion. The center of the journal (83) lies along a line running between the axis of rotation of the gear (43) and the center of gravity (C.G.) of the unbalancing weight (47) mounted on the gear. The journal supports a pair of bearings (93A and 93B) that ride on a pair of offset rods (97A and 97B). As the carriage is reciprocated back and forth along its line of movement, the journal moves back and forth along a line that lies orthogonal to the carriage movement line.

32 Claims, 7 Drawing Sheets

SHOCK STABILIZED, TWIN COUNTER WEIGHT SHUTTLE DRIVE FOR RECIPROCABLY MOUNTED CARRIAGES

TECHNICAL AREA

This invention relates to shuttling mechanisms and, more particularly, shuttling mechanisms for shuttling reciprocably mounted carriages.

BACKGROUND OF THE INVENTION

Dot matrix line printers include a plurality of dot printing mechanisms, each including a dot forming element. The dot printing mechanisms are mounted on a carriage such that the dot forming elements are located along a horizontal print line that lies perpendicular to the direction of paper movement through the printer. Located on the side of the paper remote from the dot forming elements is a platen and located between the dot forming elements and paper is a ribbon. During printing, the dot forming elements are selectively actuated to create one or more dots along the horizontal print line as the carriage is shuttled back and forth. The paper is incremented forwardly after each horizontal dot row is printed. A series of dot rows creates a horizontal row of characters, or a graphical image.

In general, dot matrix line printers fall into two categories. In the first category are dot matrix line printers wherein only the dot forming elements are shuttled. In the second category are dot matrix line printers wherein the entire print mechanism, e.g., the actuating mechanism as well as the dot forming elements, is shuttled. The present invention is useful with both categories of dot matrix line printers. More specifically, while the invention was developed for use in a dot matrix line printer wherein the entire print mechanism is shuttled, the invention also can be utilized in dot matrix line printers wherein only the dot forming elements are shuttled.

In the past, in many dot matrix line printers, the portion of the dot forming mechanism is to be shuttled has been mounted on, or forms part of, a carriage that is supported at either end by a suitable support mechanism, such as a linear bearing or a flexure. A flexure is an elongate piece of flat spring steel having one end attached to the frame of the printer and the other end attached to the carriage.

As described in U.S. patent application Ser. No. 844,092, entitled "Shuttle Drive For Flexure Mounted Carriages," by Lev Lipkovker et al., in the past, various types of carriage shuttling mechanisms have been used to shuttle the carriages of dot matrix line printers, including stepping motor, constant speed motor and linear motor driven mechanisms. Each such shuttling mechanism has various advantages and disadvantages.

The shuttling mechanism described in U.S. patent application Ser. No. 844,092, referenced above, is a weight unbalanced shuttling mechanism that comprises motor rotated unbalancing weights attached to a flexure supported carriage. The rotation of the unbalancing weights produces a vibration that causes reciprocating carriage movement. The mass and shape of the unbalancing weights is chosen to create a vibration that produces a carriage displacement. The rotary position (or phasing) of the unbalancing weights, one with respect to the other, is chosen to produce the desired force/displacement amplitude along the longitudinal axis of the carriage.

While the weight unbalanced shuttle drive system described in U.S. patent application Ser. No. 844,092 has a number of advantages over previously proposed drive mechanisms for shuttling the carriage of a dot matrix line printer, it also has disadvantages. One such disadvantage is the difficulty of maintaining a stable carriage displacement versus time relationship in the presence of external forces, such as an external bump being applied to the printer. If carriage displacement versus time changes when a printer is bumped, the carriage undergoes undesirable motions that result in the misplacing of printed dots. Misplacing of printed dots results in imperfectly formed characters, which is unacceptable in modern printers. While this problem can be avoided by sensing undesirable carriage motion and delaying printing until the effect of such motion ends, printing delay is an unacceptable resolution of this problem in modern high speed printing systems.

The present invention is directed to providing a twin counterweight shuttle drive for a reciprocably mounted carriage that avoids the foregoing disadvantage. More specifically, the invention is directed to providing a twin counterweight shuttle drive for a reciprocably mounted carriage, specifically a reciprocably mounted line printer carriage, that remains stable in the event of external bumps.

Another problem associated with the use of a weight unbalanced shuttle drive system of the type described in U.S. patent application Ser. No. 844,092 with a flexure supported carriage relates to the desirability that such systems have a low natural frequency. While a low natural frequency is desirable from energy consumption and force coupling (to the printed hammer) points of view, low natural frequency systems have a carriage displacement problem when printers are positioned on inclined surfaces. Further, each time the print mode of a line printer having a flexure mounted carriage is activated, the carriage is accelerated from zero through the system resonance point to the operating frequency of the printer. If the natural frequency of the system is low and carriage motion is uncontrolled, such acceleration causes a momentary carriage displacement much greater than the carriage displacement that occurs at the operating frequency. The time required for this undesired high amplitude excursion to be damped out defines how quickly printing can be commenced after the print mode of the printer is activated. In a system with a low damping ratio (e.g., 0.1), the typical damping time will fall in the range between 6 and 10 seconds. Obviously, a delay of 6 to 10 seconds between the time that a print command is given and when printing commences is totally unacceptable. If the damping ratio is raised to a level (approximately 0.5) that reduces the settling time to an acceptable level (e.g., 1 to 2 seconds), the force coupled by the flexures to the printer frame increases by a factor of 3 to 4 times, causing the printer to shake. Again, this is totally unacceptable.

The present invention is also directed to providing a twin counterweight shuttle drive for a reciprocably mounted dot matrix line printer carriage that is shock stabilized in a manner that avoids the foregoing disadvantages. More specifically, the invention is directed to eliminating shuttle amplitude changes when accelerating and maintaining the center point of the carriage peak-to-peak travel in the same relative position regardless of whether the printer is sitting level or inclined at some slight angle to the horizontal.

SUMMARY OF THE INVENTION

In accordance with this invention, a shock stabilized, twin counterweight shuttle drive for a reciprocably mounted carriage (such as a linear bearing or flexure supported dot matrix line printer carriage) is provided. The shuttle drive comprises a pair of equally sized and configured unbalancing weights that are rotatably coupled together and secured to the carriage. Rotation of the unbalancing weights creates a drive force that shuttles the carriage in a manner that transmits very little vibration to the frame that supports the carriage. The unbalancing weights are positioned such that the drive force is aligned with the center of gravity of the carriage and such that the centers of rotation of the unbalancing weights lie on a line that is perpendicular to the line of shuttle motion. The carriage is shock stabilized by a coupling that couples at least one of the rotating unbalancing weights to the frame that supports the carriage. The coupling point is located along a line running between the axis of rotation of the unbalancing weight and the center of gravity of the unbalancing weight. The coupling allows the coupler point to move perpendicularly, but not parallel, to the line of shuttle motion as the unbalancing weight is rotated. Since parallel motion is prevented, peak-to-peak shuttle amplitude is determined by the distance between the coupling point and the axis of rotation of the unbalancing weight. Preferably, the mass of the unbalancing weights and their effective unbalance radius (i.e., the radius of the offset of the center of mass of the unbalance weights from their center of rotation) is chosen such that the resulting peak-to-peak carriage motion produces when the unbalancing weights are rotated in the absence of the shock stabilization coupling is identical to the desired peak-to-peak shuttle motion. When this preferential restriction is followed, the shock stabilization coupling acts only in a corrective capacity to ensure pure sinusoidal motion when the carriage is subjected to a possible disturbance by a transient shock, such as the application of an external bump to the frame that supports the carriage. The shock stabilization coupling does not come into play during normal steady state operation when the ideal sinusoidal motion is being created. The shock stabilization coupling only comes into play when the ideal is being deviated from for any reason.

In accordance with other aspects of this invention, the coupling comprises: a slot formed in a bracket or frame member oriented such that the slot lies perpendicular to the line of shuttle motion; and, an offset journal formed on one end of the axle of one of the rotating unbalancing weights and positioned such that bearings mounted on the journal lie in the slot. The journal axis is offset from the axis of rotation of the unbalancing weight(s) by a distance equal to the desired peak shuttle motion amplitude and lies along a line running between the axis of rotation of the unbalancing weight(s) and the center of gravity of the unbalancing weight(s).

In accordance with alternative aspects of this invention, the coupling is formed by an arm lying parallel to the line of shuttle motion. One end of the arm is affixed to the frame that supports the carriage and the other end is journaled to one of the unbalancing weights at a rotational point that is both spaced from the axis of rotation of the weight by a distance equal to the desired peak carriage shuttle motion amplitude and lies along a line running between the axis of rotation of the unbalancing weight and the center of gravity of the unbalancing weight.

In accordance with further aspects of this invention, the unbalancing weights are coupled together and rotated by a common constant speed electric motor.

In accordance with other further aspects of this invention, preferably, the unbalancing weights include equally sized and configured gears or pulleys that are coupled together.

In accordance with yet other aspects of this invention, preferably, the teeth of the weight unbalanced gears engage one another. Also, preferably, the gears are formed of an elastomeric material.

In accordance with yet still further aspects of this invention, preferably, the weight unbalanced gears are secured to the carriage such that a line running betwen the axes of rotation of the weight unbalanced gears lies at 90° to the carriage drive force axis.

As will be readily appreciated from the foregoing description, the invention provides a shock stabilized, twin counterweight shuttle drive for a reciprocably mounted carriage, such as a dot matrix line printer carriage supported by linear bearings or flexures. The drive reciprocates the carriage in such a way that only a very small amount of vibration is transmitted to the frame that supports the carriage. The shock stabilization eliminates instability when a printer incorporating the invention is bumped by limiting the amount of carriage motion to the magnitude that the counterweights were designed to produce. Further, the shock stabilizer maintains the center point of the carriage peak-to-peak travel in the same position even if a printer incorporating the invention is mounted on a surface that is slightly inclined to the horizontal.

BRIEF DESCRIPTION OF THE DRAWINGS

The foregoing and other advantages and features of the present invention will become more readily appreciated as the same becomes better understood by references to the following detailed description when taken in conjunction with the accompanying drawings, wherein.

DESCRIPTION OF THE PREFERRED EMBODIMENTS

Figures 1, 2:
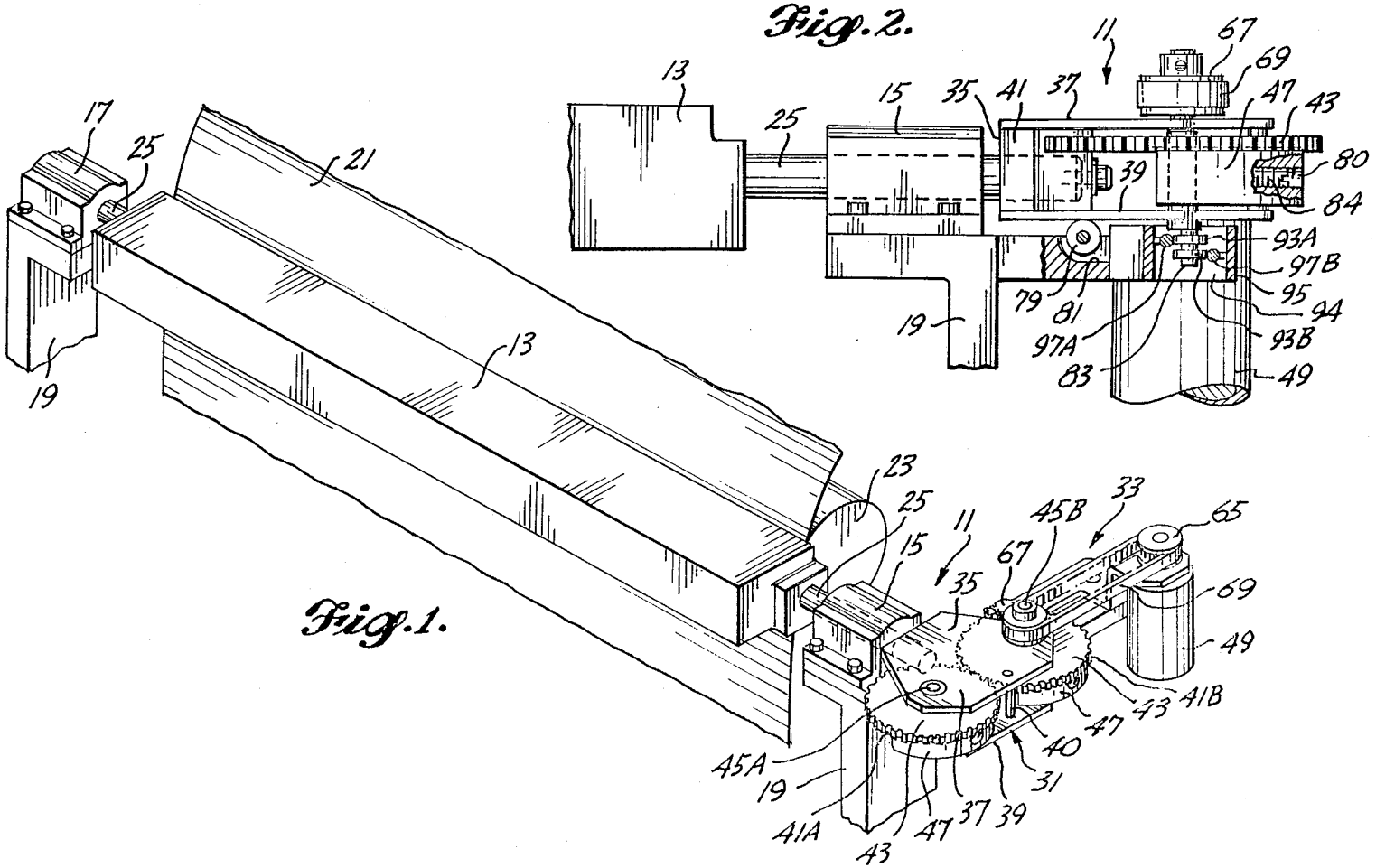
FIG. 1 is a pictorial diagram illustrating the mounting and positioning of a linear bearing mounted dot matrix line printer carriage and the mechanical components of a shuttle drive mechanism formed in accordance with the invention mounted on the carriage.
FIG. 2 is a side elevational view of the embodiment of the invention illustrated in FIG. 1.
Figure 3:
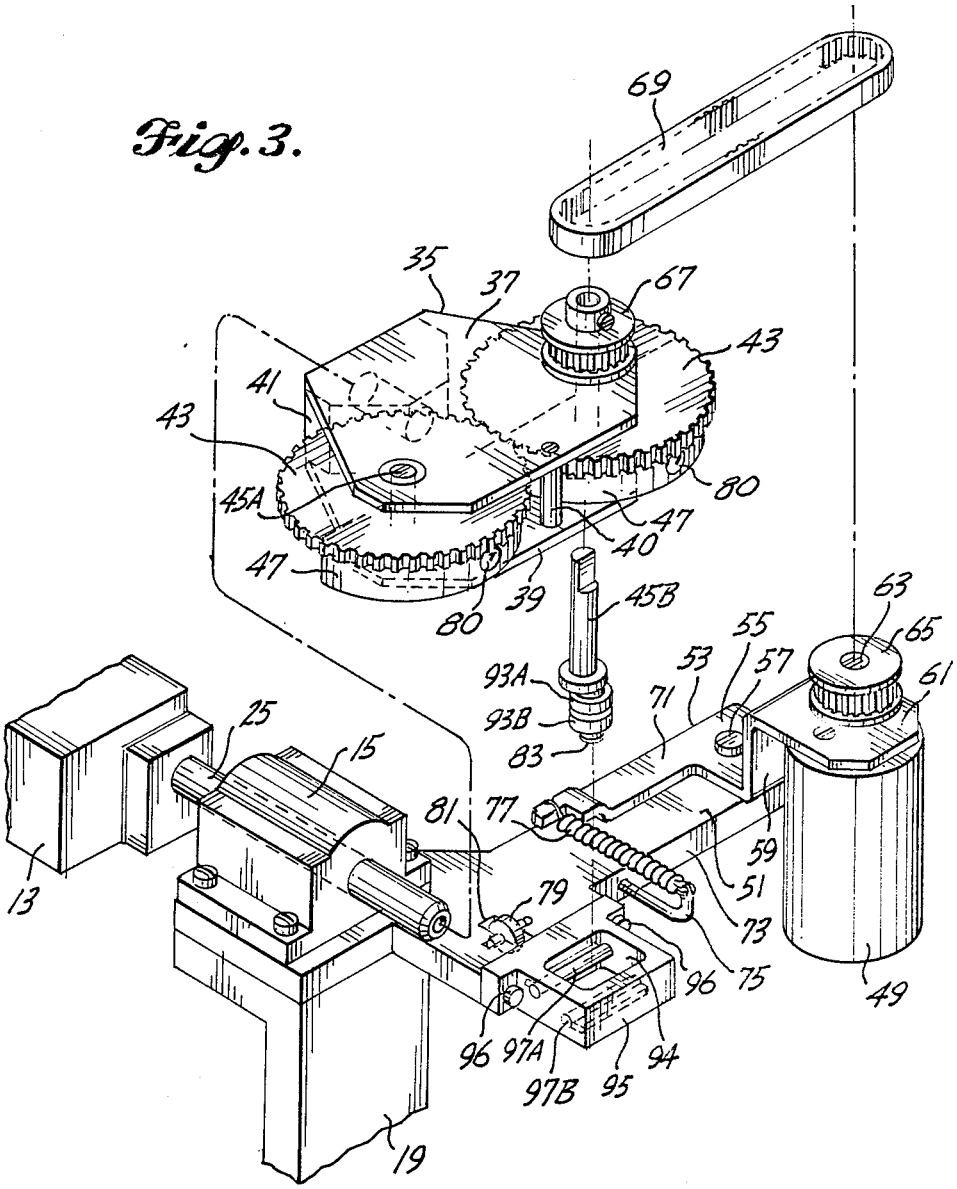
FIG. 3 is an exploded view of the twin counterweight shuttle drive mechanism illustrated in FIGS. 1 and 2.

FIGS. 1, 2 and 3 illustrate a shock stabilized twin counterweight shuttle drive 11 formed in accordance with the invention secured to a linear bearing supported dot matrix line printer carriage 13. More specifically, the carriage 13 is elongate. Located on either end of the carriage 13 is a linear bearing 15 and 17. The linear bearings 15 and 17 are attached to the frame of the printer incorporating the invention. For ease of illustration the frame is depicted as a pair of spaced apart uprights 19. The linear bearings are shown as mounted atop the uprights 19.

Located on the same side of the carriage 13 as the paper 21 to be printed on are a plurality of dot printing mechanisms (not shown), each of which includes a hammer and a hammer actuating magnetic structure. While the carriage 13 can support various types of dot printing mechanisms, preferably, the hammers are leaf-like and support dot printing elements located along a line that faces the paper 21. Located on the remote side of the hammers from the dot printing elements are the hammer actuating magnetic structures, which retract and release the hammers to create dots by pressing a ribbon (also not shown) and the paper 21 against a platen 23. An example of a dot printing mechanism of this type is described in U.S. Pat. No. 4,351,235 entitled "Dot Printing Mechanism For Dot Matrix Line Printers" filed Sept. 11, 1980 by Edward D. Bringhurst and assigned to the assignee of the present application.

Extending outwardy from either end of the carriage 13 are stub shafts 25. The longitudinal axes of the stub shafts 25 are coaxial with one another. Further, the common longitudinal axis of the stub shafts 25 is horizontal and passes through the combined center of gravity of the carriage 13 and the print mechanism mounted on the carriage. The stub shafts 25 are mounted in the linear bearings 15 and 17.

The twin counterweight shuttle 11 includes a vibration producing mechanism 31 and a driving mechanism 33. The vibration producing mechanism 31 is mounted on the outer end of one of stub shafts 25 and the driving mechanism is mounted atop one of the uprights 19 that forms part of the printer frame.

The vibration producing mechanism 31 includes a yoke 35 that comprises a pair of spaced apart flanges 37 and 39 and a crossmember 41. The crossmember is attached to the outer end of the stub shaft 25 on which the vibration producing mechanism is mounted. The yoke 35 is oriented such that the spaced apart flanges 37 and 39 lie in horizontal planes located on either side of the common longitudinal axis of the stub shafts 25. The flanges are held spaced apart by a spreader rod 40. If desired, the yoke could be formed of a single piece casting to reduce cost.

The vibration producing mechanism 31 also includes a pair of gear coupled unbalance weights 41A and 41B. Each of the gear coupled unbalance weights 41A and 41B includes a spur gear 43 of identical size. Preferably, in order to minimize noise, the spur gears 43 are formed of an elastomeric material. The spur gears are mounted on vertically oriented shafts 45A and 45B that extend between the horizontal flanges 37 and 39 of the yoke 35. Thus, the spur gears line in a horizontal plane. The shafts 45A and 45B are positioned such that the teeth of the spur gears 43 engage each other. Affixed to the lower surface of each of the spur gears 43 is an unbalancing weight 47. Preferably, each of the unbalancing weights 47 is pie shaped. While the weights 47 illustrated in FIGS. 1-3 are substantially semicircular, it is to be understood that other pie shapes can be utilized. (See FIGS. 5 and 6.) Regardless of shape, the unbalancing weights 47 have an identical configuration and mass. The weights are fomred of a suitably heavy material, such as iron, for example. The unbalancing weights 47 are attached to the gear 43 on which they are mounted. Preferably, the unbalancing weights are joined to the gears by screws countersunk into the gears and threaded into the weights. Further, the unbalancing weights are positioned on their respective gears 43 in mirror orientations. More specifically, the unbalancing weights are positioned such that when the gears 43 are oriented such that the teeth adjacent the unbalancing weights 47 engage one another, the unbalancing weights are positioned near one another. Contrariwise, when the teeth located on the edge of the gears 43 opposite the unbalancing weights 47 engage one another, the unbalancing weights 47 are the furthest apart.

As a result of the teeth of the gears engaging one another, when one of the gears 43 is rotated in one direction (clockwise, for example), the other gear rotates in the opposite direction (counterclockwise). When the gears are rotated, the unbalancing weights 47 set up two equal centrifugal forces, the resultant of which always makes the same angle with the longitudinal axes of the stub shafts 25. As a result, the components of force created by the rotating gears that lie orthogonal to the stub shaft longitudinal axes cancel and the parallel components of force are summed. The summed parallel components of force cause movement of the carriage 13 along the longitudinal axes of the stub shafts.

The gears 43 are rotated by a constant speed electric motor 49 that forms part of the driving mechanism 33. More specifically, the driving mechanism includes a horizontally oriented plate 51 that is attached to or forms part of the printer frame. For each of illustration, the plate 51 is illustrated as mounted atop one of the uprights 19, beneath the related linear bearing 15. Mounted atop the plate 51 is a motor support bracket 53. As best illustrated in FIG. 3, the motor support bracket has a generally Z-shaped configuration. One leg 55 of the bracket lies atop the plate 51 and is rotatably attached thereto by a pin 57. The crossmember 59 of the Z-shaped motor support bracket extends vertically upwardly and the other leg 61 extends outwardly, in a horizontal plane.

The constant speed electric motor 49 is attached to the bottom of the other leg 61 and oriented such that the shaft 63 of the motor lies vertical and passes through a hole (not shown) in the other leg 61. Mounted on the end of the motor shaft 63, above the other leg is a first toothed pulley 65. The shaft 45B on which the nearest spur gear 43 is mounted extends above the upper surface of the upper flange 37 of the yoke 35. Mounted on the upper extension is a second toothed pulley 67. The motor support bracket 53 and the yoke 35 are sized such that the first and second toothed pulleys 65 and 67 lie in a common horizontal plane. The first and second toothed pulleys 65 and 67 are joined by a timing belt 69. The axis of the timing belt is perpendicular to the carriage axis when the carriage is at the midpoint of its path of travel.

Extending outwardly from the leg 55 of the motor support bracket 53 that lies atop the plate 51 is an arm 71. The arm 71 overlies the plate 51. Extending outwardly from the edge 73 of the plate 51 that faces the motor 49 is an L-shaped pin 75. Extending between the arm 71 and the L-shaped pin 75 is a coil spring 77. As will be readily appreciated from the foregoing description and viewing FIG. 3, the coil spring 77 creates a force that counteracts the force applied to the shaft 63 of the motor 49 via the timing belt 69 and maintains proper belt tension when the rotation of the spur gears causes the carriage to shuttle back and forth in the manner herein described. Clockwise (when viewed from the end) rotation of the yoke when the carriage is shuttled back and forth is prevented by a small roller 79 mounted in a slot 81 formed in the plate 51, beneath the yoke 35.

In accordance with the invention, the unbalancing weights 47 are chosen such that the desired peak-to-peak ampltiude of shuttle motion is defined by the following relationship:

$$A=2mr/M \quad (1)$$

where:

A = the desired peak amplitude of the system in either direction from a center location;

m = the eccentric mass of one of the couterweights;

r = the radius of the offset of the eccentric mass, m, from the center of rotation; and, M = the total shuttled mass, i.e., the carriage plus all of the components mounted on the carriage, including the vibration producing mechanism 31 of the twin counterweight shuttle.

In accordance with the invention, the peak amplitude value A is utilized to determine the location of an offset journal 83 associated with one of the gears 43 that is constrained to shock stabilize the carriage 13. It should be noted that the amplitude is independent of the frequency of operation.

Figure 4:
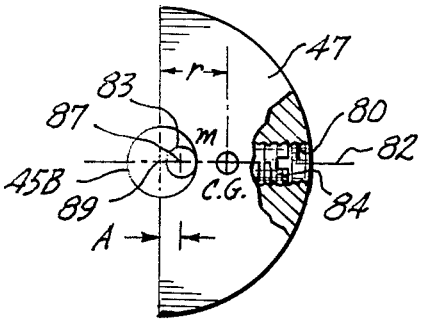
FIG. 4 is a pictorial diagram depicting certain unbalancing weight distance relationships.

In addition to being tuned to the total shuttle mass and the amplitude of movement, the unbalance weights are tuned to one another. In this regard, as best illustrated in FIG. 4, each of the unbalance weights includes a threaded hole 80 located along its principal bisecting radius line 82. Mounted in the hole is a metal slug 84. The metal slug is moved inwardly and outwardly to "tune" the unbalance weights to one another.

Figure 5:
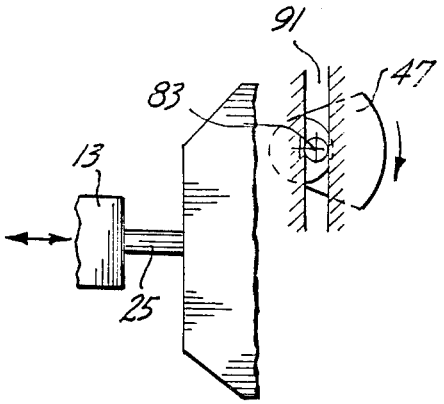
FIG. 5 is a pictorial diagram of the shock stabilizer portion of the embodiment of the invention illustrated in FIGS. 1–3.

As also illustrated in FIG. 4, the center of the offset journal 83 lies along the radius line 82 that passes through the center of gravity (C.G.) of the unbalanced weights 47 attached to the constrained gear 43. The center 87 of the offset journal 83 is spaced from the axis of rotation 89 of the gear by the desired peak amplitude value A. As illustrated in FIG. 5, the offset journal 83 can be constrained by positioning the journal in a slot 91 formed in a structure that is affixed to the frame of the printer. The offset journal 83 and the slot 91 must be formed and positioned such that the journal is free to slide back and forth along a path that lies transverse to the carriage movement path as the carriage moves back and forth. While FIG. 5 shows constraining a single gear offset journal, since both gears are affixed to the carriage, if desired, a constraining offset journal can be associated with the other gear. In most instances, such redundancy will be unnecessary. The sidewalls of the slot 91 can be solid, or resilient if aditional damping is desired.

FIGS. 2 and 3 show the offset journal 83 constraining mechanism in the embodiment of the invention illustrated in FIGS. 1–3. The offset journal 83 is formed on the lower end of the shaft 45B that is coupled to the motor 49 by the timing belt 69 and the first and second toothed pulleys 65 and 67. Mounted on the offset journal 83 are a pair of spaced apart bearings 93A and 93B. The offset journal and the bearings lie in a rectangular aperture 94 formed in a bracked 95 that is attached by bolts 96 to the edge 73 of the plate 51 that faces the motor 49. Extending across the rectangular aperture 94 in a direction that lies transverse to the direction of carriage movement are a pair of rods 97A and 97B. The rods are horizontally spaced apart by a distance equal to the diameter of the journal bearings 93A and 93B and vertically offset by a distance equal to the spacing between the bearings. Further, the rods 97a and 97B are positioned so as to be impinged on by the journal bearings 93A and 93B when the journal bearings are positioned in the rectangular aperture. Hence, the rods form the constraining slot 91 illustrated in FIG. 5 and described above. If desired, the rods could be replaced with flat metal bars, or any other suitably shaped constraining element.

While a single bearing, double rod constraining arrangement could be utilized, the double bearing, double rod constraining arrangement described in the prceding paragraph is preferred because it results in reduced wear. Since each of the rods are preloaded against a separate bearing, each bearing rolls freely on its associated rod. If a single bearing and coplanar rods are used, the preloading effect causes the bearing to want to slide on the unloaded rod and roll on the loaded rod, resulting in excessive wear. The use of two bearings and vertically offset rods avoids this effect.

Figure 6:
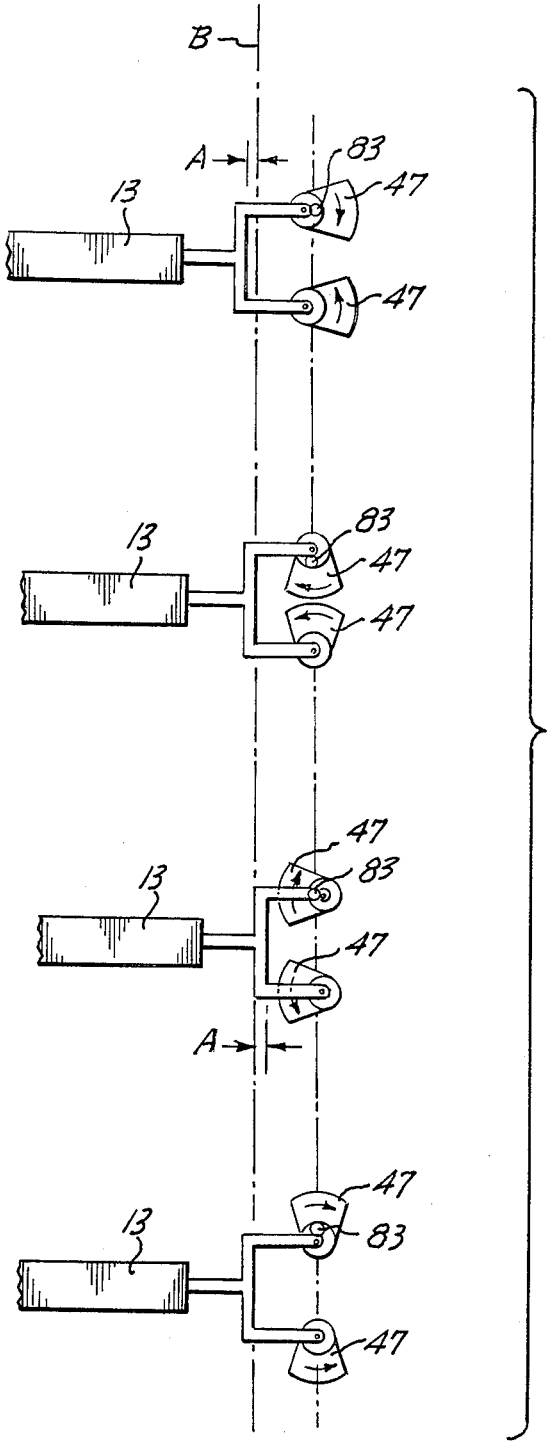
FIG. 6 is a series of sequential views illustrating the operation of the shock stabilized twin counterweight shuttle drive for linear bearing mounted carriages illustrated in FIGS. 1–3.

FIG. 6 is a sequence of views that pictorially illustrate the movement of the carriage 13 with respect to a reference line B that is fixed in space as the unbalancing weights 47 are rotated in opposite directions as a result of the rotation gears 43 on which the unbalancing weights 47 are mounted. The gears are omitted for purposes of clarity. As shown in the first view, when the unbalancing weights 47 are in their rightmost position, the carriage 13 is in its leftmost position. The amount of displacement from the center or neutral position is the journal offset distance A. The second view of FIG. 6 illustrates the unbalancing weights 47 rotated to a position where the weights lie adjacent one another. When in this position, the carriage 13 is in its center or neutral position. In this position, the axis of rotation is aligned with the journal axis and the carriage 13 is not offset. The third view of FIG. 6 depicts the unbalancing weights 47 in their leftmost position. When in this position, the carriage 13 is in its rightmost position. In this position, the carriage is offset to the right by the journal offset distance A. The last view of FIG. 6 shows the offset weights 47 in their most spaced apart position. In this position the axis of rotation is again aligned with the journal axis and the carriage is in its neutral or center position.

As will be readily appreciated from viewing FIG. 6, the locus of the axis of movement of the journal 83 is a vertical line that lies 90° to the direction of motion of the carriage 13. As a result, the shuttle carriage 13 is forced to behave such that the peak-to-peak amplitude of movement is constant for all frequencies of operation. Further, the carriage is shuttled with pure sinusoidal motion; and, the center point of travel of the carriage is maintained constant for all attitudes of the carriage and, thus, a printer incorporating the carriage. Finally, because carriage motion is constrained, such motion is insensitive to extremely applied shocks.

Figure 9:
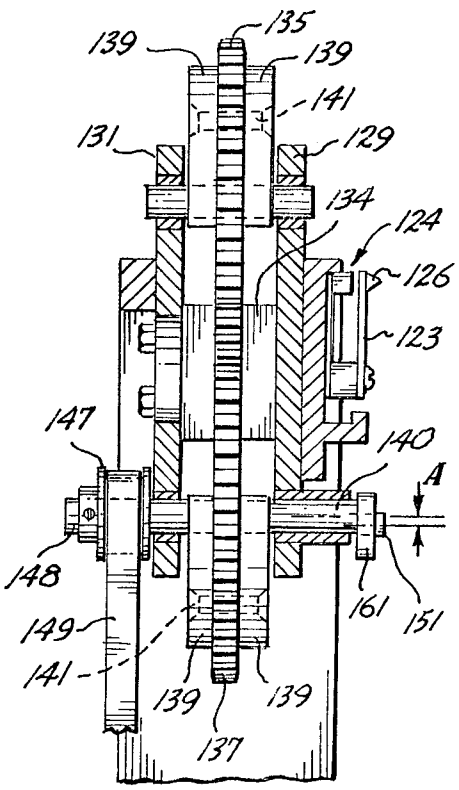
FIG. 9 is a cross-sectional view of the twin counterweight shuttle drive mechanism illustrated in FIGS. 7 and 8 taken along line 9—9 of FIG. 8.
Figure 7:
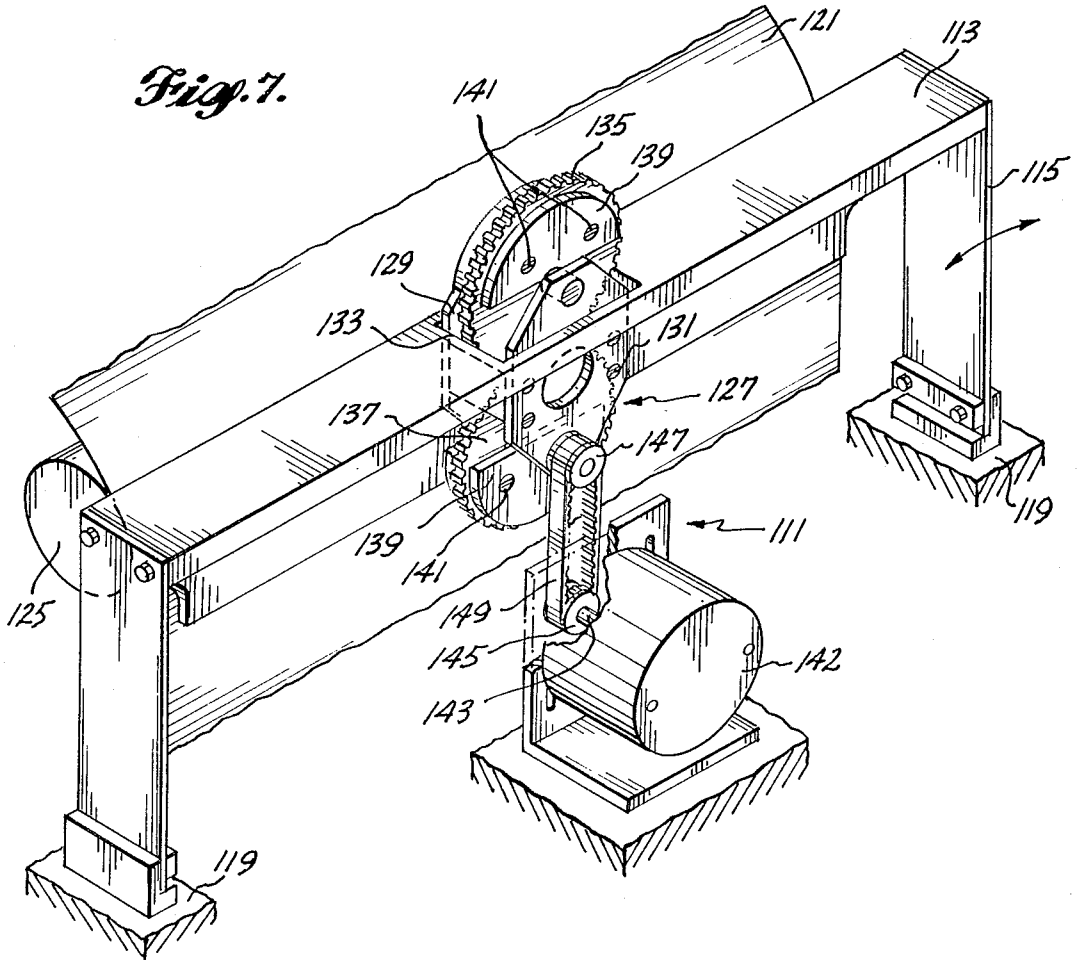
FIG. 7 is a pictorial diagram illustrating the mounting and positioning of a flexure mounted dot matrix line printer carriage and the mechanical components of a shuttle drive mechanism formed in accordance with the invention mounted on the carriage.
Figure 8:
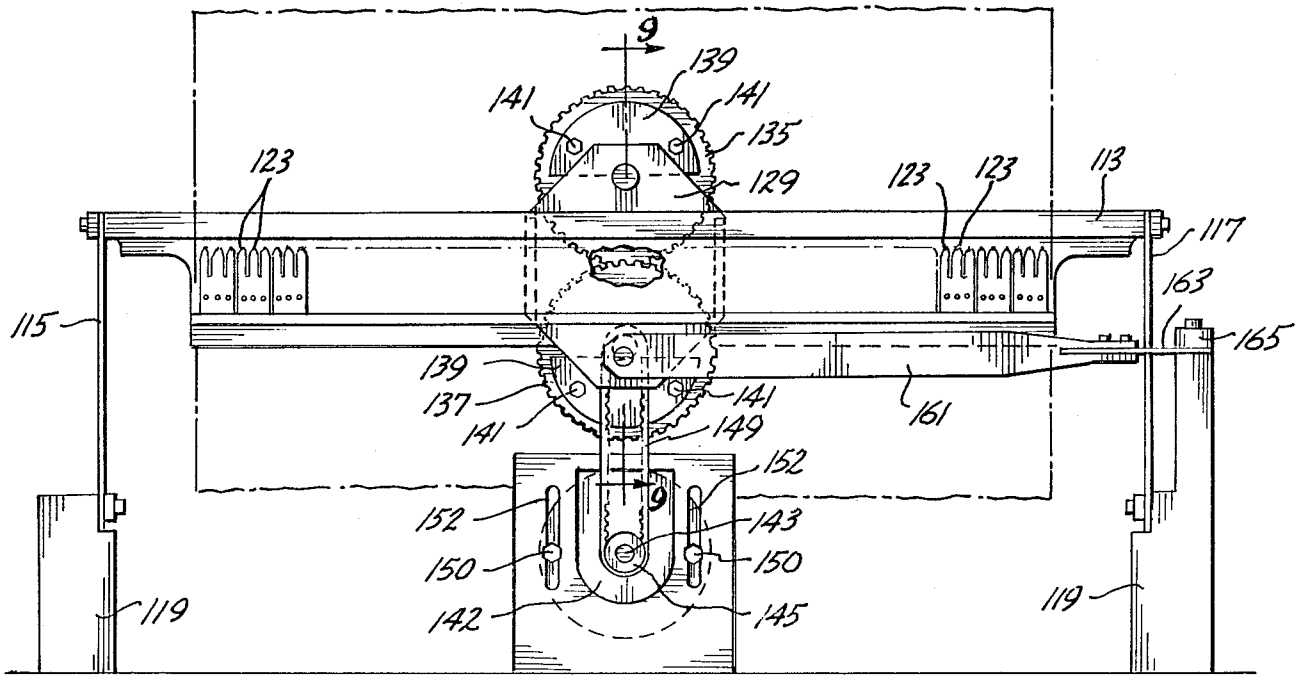
FIG. 8 is an elevational view of the embodiment of the invention illustrated in FIG. 7.

FIGS. 7, 8 and 9 illustrate an alternative embodiment of a shock stabilized twin counterweight shuttle drive 111 formed in accordance with the invention mounted on a flexure supported dot matrix line printer carriage 113. More specifically, the carriage 113 is elongate. Located on either end of the carriage 113 is a flat flexure 115 and 117. The flexures 115 and 117 are vertically oriented and lie parallel to one another. The lower ends of the flexures 115 and 117 are attached to the frame 119 of the printer incorporating the shuttle drive 111.

The carriage 113 is mounted between the upper ends of the flexures 115 and 117. Located on the same side of the carriage 113 as the paper 121 to be printed on are a plurality of dot printing mechanisms, each of which includes a hammer 123 and a hammer actuating magnetic structure 124 (FIG. 9). While the carriage 113 can support various types of dot printing mechanisms, preferably, the hammers are leaf-like and support dot printing elements 126 located along a line that faces the paper 121. Located on the remote side of the hammers 123 from the dot printing elements 126 are the hammer actuating magnetic structures 124, which retract and release the hammers 123 to create dots by pressing a ribbon (not shown) and the paper 121 against a platen 125. As noted above, an example of a dot printing mechanism of this type is described in U.S. Pat. No. 4,351,235 entitled "Dot Printing Mechanism For Dot Matrix Line Printers" filed Sept. 11, 1980 by Edward D. Bringhurst and assigned to the assignee of the present application.

The twin counterweight shuttle 111 includes a vertically oriented frame 127 secured to the carriage 113. As illustrated, the frame 127 may include a pair of vertically oriented plates 129 and 131 mounted in a slot 133 formed in the carriage 113. The plane of the plates 129 and 131 lies parallel to the longitudinal axis of the carriage 113. Further, the plates 129 and 131 lie on either side of the longitudinal axis of the carriage 113, and are held spread apart by spacer blocks 134 located along the vertical edges of the plates.

Mounted between the plates 129 and 131, at the upper and lower ends thereof are a pair of identically sized gears 135 and 137. The gears 135 and 137 are mounted such that they mesh with one another. The gears may be formed of nylon, for example, or, more preferably, an elastomeric material for quieter operation.

Mounted on each outer face of each of the gears 135 and 137 is an unbalancing weight 139. Preferably, each of the unbalancing weights 139 is pie shaped. While the weights 139 illustrated in FIGS. 7–9 are substantially semicircular, as with the previously described embodiment of the invention, it is to be understood that other pie shapes can be utilized. Regardless of shape, all of the unbalancing weights 139 have an identical configuration and mass. The weights are formed of a suitably heavy material, such as iron, for example. The unbalancing weights 139 located on the opposite sides of the gears 135 and 137 are aligned with one another. The related pairs of unbalancing weights 139 are attached to the gear on which they are mounted. Preferably, the unbalancing weight pairs are joined by screws 141 countersunk in one weight 139 and threaded into the other weight. Further, the unbalancing weights are positioned on their respective gears in mirror orientations. More specifically, the unbalancing weights are positioned such that when the gears are oriented such that the teeth adjacent the unbalancing weights 139 engage one another, the unbalancing weights are positioned near one another. Contrariwise, when the teeth located on the edge of the gear 135 opposite the unbalancing weights 139 engage one another, the unbalancing weights 139 are the furthest apart. While pairs of unbalancing weights 139 are illustrated in FIGS. 7–9 as mounted on each gear 135 and 137, it is to be understood that, like the embodiment of the invention illustrated in FIGS. 1–3 and described above, a single unbalancing weight can be mounted on each gear, if desired. As a matter of fact this may be preferred in some environments.

As a result of the teeth of the gears engaging one another, when one of the gears is rotated in one direction (clockwise, for example), the other gear rotates in the opposite direction (counterclockwise). When the gears are rotated, the unbalancing weights set up two equal centrifugal forces, the resultant of which always makes the same angle with the horizontal. As a result, the vertical components of force created by the rotating gears cancels and the horizontal components of force are summed. The summed horizontal components of force cause movement of the carriage 113 along the longitudinal axis of the carriage.

The gears 135 and 137 are rotated by a constant speed electric motor 142 attached to the frame of the printer, beneath the carriage 113. The electric motor 142 is mounted on the vertical leg of an L-shaped bracket 144 such that the shaft 143 of the motor lies perpendicular to the axis of movement of the carriage 113. The shaft 143 of the constant speed electric motor is coupled to the lower gear 137. The illustrated coupling mechanism comprises a timing belt pulley 145 mounted on the shaft 143 of the constant speed electric motor 142, a pulley 147 mounted on the shaft 148 on which the lower gear 137 is mounted and a toothed belt 149 that connects the two small pulleys together. The electric motor 142 is attached to the vertical leg of the L-shaped bracket 144 by screws 150 mounted in vertical slots 152. As a result, the motor can be vertically positioned to create a suitable tension in the toothed coupling belt 149.

While the twin counterweight shuttle drive is illustrated in FIGS. 7–9 as mounted in the center of the carriage 113, this is for convenience of illustration only. The shuttle drive could be mounted any place along the length of the carriage, or extend outwardly from either end thereof. As a matter of fact, in an actual embodiment of the invention it may be preferable to mount the twin counterweight shuttle drive at one end of the carriage in order to allow maximum freedom in the selection of printer options. Further, while the twin counterweight shuttle drive is illustrated as rigidly fastened to the carriage, it could be flexure attached to the carriage, if desired. Also, while the gears 135 and 137 are shown as vertically oriented, the gears and their associated unbalancing weights could be horizontally oriented, as in the embodiment of the invention illustrated in FIGS. 1–3 and described above.

When the gears are rotated, the unbalance weights create the heretofore described horizontal force that shuttles the carriage. In order to minimize the coupling of this force to the printer frame, the flexures 115 and 117 should have the lowest K-factor possible consistent with the need for the carriage 113 to maintain a stable vertical relationship to the platen 125. That is, the flexure K-factor should be high enough to avoid buckling of the flexures during the operation of the printer. A K-factor system having a resonance frequency around 1 Hz is adequately low and will result in an essentially constant peak-to-peak shuttle amplitude at conventional line printer operating frequencies.

As will be readily recognized by those familiar with line printers that include flexure supported carriages, in the absence of a compensating mechanism, low K-factor flexures result in a carriage 113 that will make uncontrolled gyrations any time the frame 119 of the printer is bumped. The invention avoids this undesirable result by sizing the unbalancing weights 139 in accordance with the desired peak-to-peak shuttle amplitude and providing a stabilizing coupling that limits carriage movement to the selected peak-to-peak amplitude. With respect to sizing, the unbalance weights are chosen to conform to the mathematic relationship set forth in Equation (1) described above. This relationship is depicted in FIG. 4.

Figure 10:
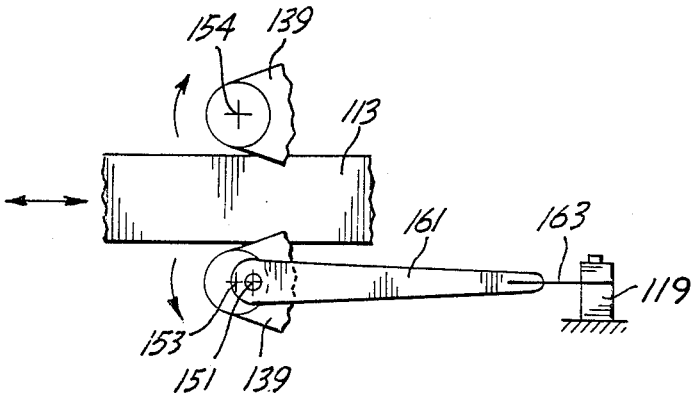
FIG. 10 is a pictorial diagram of the shock stabilizer portion of the embodiment of the invention illustrated in FIGS. 7-9; and, FIG. 11 is a series of sequential views illustrating the operation of the shock stabilized twin counterweight shuttle drive for linear bearing mounted carriages illustrated in FIGS. 7-9.

FIG. 10 is a pictorial diagram of the stabilizing coupling used in the embodiment of the invention to limit carriage motion in accordance with the invention. As shown in FIG. 9, the shaft 140 on which one of the gear unbalancing weight combinations is mounted includes an offset journal 151. As shown in FIGS. 8 and 10, the journal 151 is connected to the frame 119 of the printer via a horizontal stabilizer link 161 and a flexure 163. The arm prohibits horizontal movement of the journal 151 while the flexure allows vertical movement. As a result, again horizontal carriage motion is limited to twice the distance (A) between the center of unbalance weight rotation 153 and the center of the journal 151.

Figure 11:
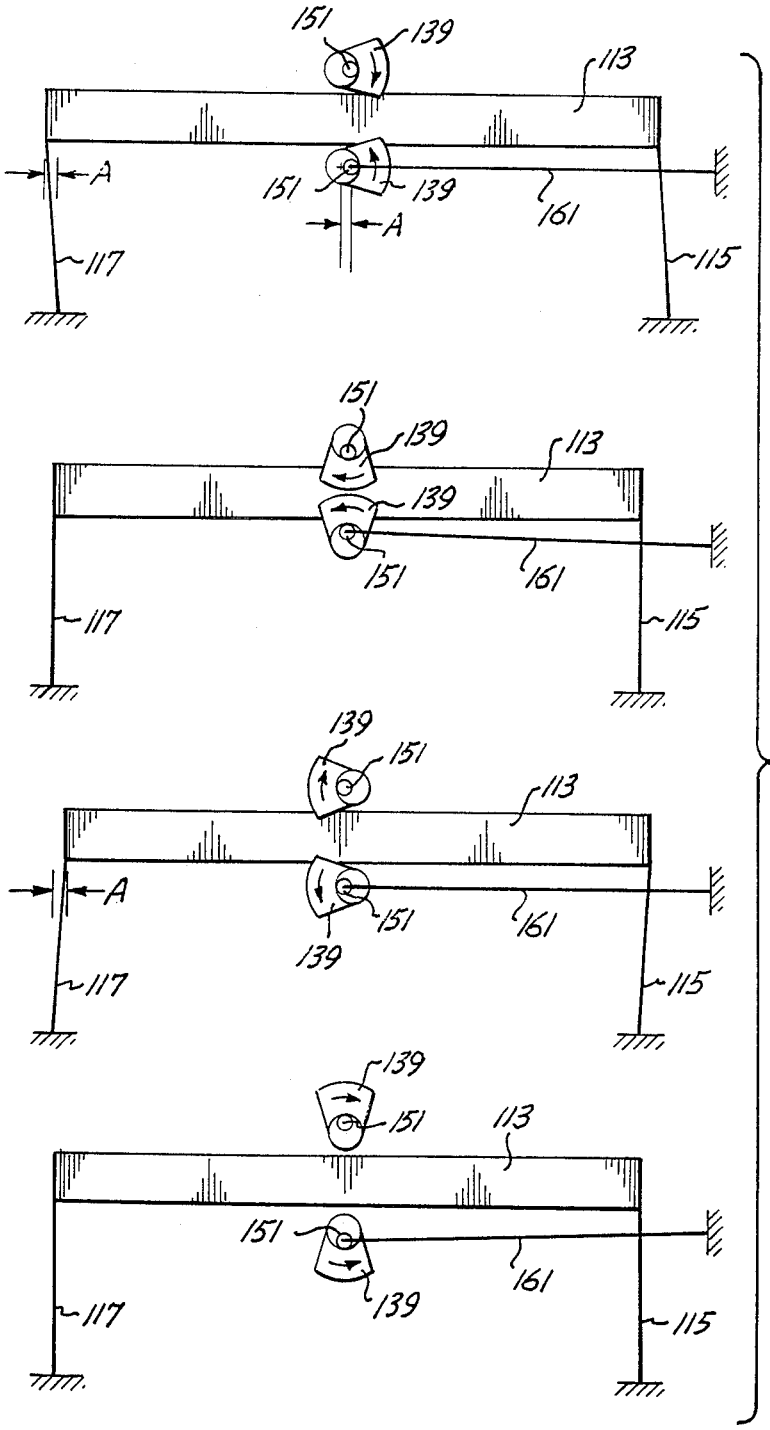

FIG. 11 is a sequence of views that pictorially illustrate the movement of the carriage 113 as the unbalancing weights 139 are rotated in opposite directions as a result of the rotation of the gears 135 and 137 on which the unbalancing weights 139 are mounted. As shown in the first view, when the unbalancing weights 139 are in their rightmost position, the carriage 113 is in its leftmost position. The amount of displacement from the center or neutral position is the journaled offset distance A. The second view of FIG. 11 illustrates the unbalancing weights 139 rotated to a position where the weights lie adjacent one another. When in this position, the carriage 113 is in its center or neutral position. In this position, the flexures 115 and 117 are vertical and the carriage 113 is not offset. The third view of FIG. 11 depicts the unbalancing weights 139 in their leftmost position. When in this position, the carriage 113 is in its rightmost position. In this position, the carriage is offset to the right by the journal offset distance A. The last view of FIG. 11 shows the unbalancing weights 139 in their most spaced-apart position. In this position the flexures 115 and 117 are again vertical and the carriage is in its neutral or center position.

As will be readily appreciated from viewing FIG. 11, like in FIG. 6, the locus of the axis of movement of the offset journal 151 is a vertical line that lies 90° to the direction of motion of the carriage 113. As a result, the shuttle carriage 113 is forced to behave such that the peak-to-peak amplitude of movement is constant for all frequencies of operation. Again, there is no resonance bump in the amplitude versus frequency curve of the carriage. Further, the carriage is shuttled with pure sinusoidal motion; and, the center point of travel of the carriage is maintained constant for all attitudes of the carriage and, thus, a printer incorporating the carriage. Finally, becasue carriage motion is constrained, such motion is insensitive to externally applied shocks.

While two arms, as provided to the single arm shown in FIGS. 10 and 11, could be included to provide a perfectly balanced system, in most embodiments of the invention, a single stabilizer arm will be adequate. If desired, the flexures 163 of the stabilizer arm (which are provided to allow the journal end of the arm to rise and fall) can be attached to the printer frame via either a resilient or a solid coupling bracket 165.

While preferred embodiments of the invention have been illustrated and described, it is to be understood that, within the scope of the appended claims, various changes can be made therein. Thus, it is to be understood that the invention can be practiced otherwise than as specifically described herein.

The embodiments of the invention in which an exclusive property or privilege is claimed are defined as follows:

1. A shock stabilized, twin counterweight shuttle drive for reciprocating a carriage that is reciprocably mounted on a supporting structure comprising:

a pair of equally sized and configured unbalancing weights rotatably coupled together and secured to said carriage so as to be entirely supported by said carriage, said unbalancing weights being positioned such that the rotation of said unbalancing weights in opposite directions creates a drive force that reciprocably shuttles said carriage along a line of motion, said unbalancing weights also being positioned such that said drive force is aligned with the center of gravity of the carriage and such that the centers of rotation of the unbalancing weights lie along a line that is perpendicular to the line of shuttle motion;

rotation means coupled to said pair of equally sized and configured unbalancing weights for rotating said pair of equally sized and configured unbalancing weights in opposite directions; and, shock stabilizing means for stabilizing the shuttle motion of said carriage by coupling at least one of said unbalancing weights to the supporting structure on which said carriage is reciprocably mounted, said shock stabilizing means comprising a coupling that couples a coupling point spaced from the axis of rotation of said at least one of said unbalancing weights by a predetermined distance and located along a line running between the axis of rotation of said at least one unbalancing weight and the center of gravity of said at least one unbalancing weight to said supporting structure such that said coupling point can move perpendicularly, but not parallel, to the line of shuttle motion as said at least one unbalancing weight is rotated.

2. A shock stabilized, twin counterweight shuttle drive for reciprocating a carriage that is reciprocably mounted on a supporting structure as claimed in claim 1, wherein said predetermined distance determines the peak-to-peak shuttle motion of said carriage.

3. A shock stabilized, twin counterweight shuttle drive for reciprocating a carriage that is reciprocably mounted on a supporting structure as claimed in claim 2, wherein said coupling comprises: a bracket mounted on said supporting structure that contains a slot oriented such that the slot lies perpendicular to the line of shuttle motion; and, a journal positioned in said slot, said journal with said at least one unbalancing weight and being positioned at said coupling point that is spaced from the axis of rotation of said at least one unbalancing weight by said peak-to-peak determining distance and located along a line running between the axis of rotation of said at least one unbalancing weight and the center of gravity of said at least one unbalancing weight.

4. A shock stabilized, twin counterweight shuttle drive for reciprocating a carriage that is reciprocably mounted on a supporting structure as claimed in claim 3, wherein said unbalancing weights are coupled together and wherein said rotation means comprises a constant speed electric motor coupled to said unbalancing weights for rotating said unbalancing weights.

5. A shock stabilized, twin counterweight shuttle drive for reciprocating a carriage that is reciprocably mounted on a supporting structure as claimed in claim 4, wherein said unbalancing weights include equally sized ad configured gears that are coupled together.

6. A shock stabilized, twin counterweight shuttle drive for reciprocating a carriage that is reciprocably mounted on a supporting structure as claimed in claim 5, wherein said gears are formed of an elastomeric material and the teeth of said gears engage one another.

7. A shock stabilized, twin counterweight shuttle drive for reciprocating a carriage that is reciprocably mounted on a supporting structure as claimed in claim 6, wherein said gears are secured to said carriage such that the line running between the axes of rotation of said gears is horizontal and the carriage drive force axis is horizontal.

8. A shock stabilized, twin counterweight shuttle drive for reciprocating a carriage that is reciprocably mounted on a supporting structure as claimed in claim 2, wherein said coupling is formed by an arm lying generally parallel to the line of shuttle motion, one end of said arm being affixed to said supporting structure and the other end of said arm being rotatably connected to said one of said unbalancing weights at said coupling point that is spaced from the axis of rotation of said at least one weight by said peak-to-peak determining distance and located along a line running between the axis of rotation of said at least one unbalancing weight and the center of gravity of said at least one unbalancing weight.

9. A shock stabilized, twin counterweight shuttle drive for reciprocating a carriage that is reciprocably mounted on a supporting structure as claimed in claim 8, wherein said unbalancing weights are coupled together and wherein said rotation means comprises a constant speed electric motor coupled to said unbalancing weights for rotating said unbalancing weights.

10. A shock stabilized, twin counterweight shuttle drive for reciprocating a carriage that is reciprocably mounted on a supporting structure as claimed in claim 9, wherein said unbalancing weights include equally sized and configured gears that are coupled together.

11. A shock stabilized, twin counterweight shuttle drive for reciprocating a carriage that is reciprocably mounted on a supporting structure as claimed in claim 10, wherein said gears are formed of an elastomeric material and the teeth of said gears engage one another.

12. A shock stabilized, twin counterweight shuttle drive for reciprocating a carriage that is reciprocably mounted on a supporting structure as claimed in claim 11, wherein said gears are secured to said carriage such that the line running between the axes of rotation of said gears is vertical and the carriage drive force axis is horizontal.

13. In a dot matrix line printer wherein a series of dot printing mechanisms are mounted side by side on an elongate carriage supported by linear bearings attached to the frame of said printer for reciprocating movement along a print line defined by said dot printing mechanisms, the improvement comprising a shock stabilized, twin counterweight shuttle drive, said shock stabilized, twin counterweight shuttle drive including:

a pair of equally sized and configured unbalancing weights rotatably coupled together and secured to said carriage so as to be entirely supported by said carriage, said unbalancing weights being positioned such that the rotation of said unbalancing weights in opposite directions creates a drive force that reciprocably shuttles said carriage along said print line, said unbalancing weights also being positioned such that: (i) said drive force is aligned with the center of gravity of the carriage and the dot printing and any other mechanisms mounted on the carriage; and (ii) the centers of rotation of the unbalancing weights lie along a line that is perpendicular to said print line;

rotation means coupled to said pair of equally sized and configured unbalancing weights for rotating said pair of equally sized and configured unbalancing weights in opposite directions; and, shock stabilizing means for stabilizing the shuttle motion of said carriage by coupling at least one of said unbalancing weights to the frame of said printer, said shock stabilizing means comprising a coupling that couples a coupling point spaced from the axis of rotation of said at least one of said unbalancing weights by a predetermined distance and located along a line running between the axis of rotation of said at least one unbalancing weight and the center of gravity of said at least one unbalancing weight to said supporting structure such that said coupling point can move perpendicularly, but not parallel, to the line of shuttle motion as said at least one unbalancing weight is rotated.

14. The improvement claimed in claim 13, wherein said pair of equally sized and configured unbalancing weights are secured to one end of said elongate carriage.

15. The improvement claimed in claim 13, wherein said predetermined distance determines the peak-to-peak shuttle motion of said carriage.

16. The improvement claimed in claim 15, wherein said pair of equally sized and configured unbalancing weights are secured to one end of said elongate carriage.

17. The improvement claimed in claim 15, wherein said coupling comprises: a bracket mounted on said supporting structure that contains a slot oriented such that the slot lies perpendicular to the line of shuttle motion; and, a journal positioned in said slot, said journal associated with said at least one unbalancing weight and being positioned at said coupling point that is spaced from the axis of rotation of said at least one unbalancing weight by said peak-to-peak determining distance and located along a line running between the axis of rotation of said at least one unbalancing weight and the center of gravity of said at least one unbalancing weight.

18. The improvement claimed in claim 17, wherein said unbalancing weights are coupled together and wherein said rotation means comprises a constant speed electric motor coupled to said unbalancing weights for rotating said unbalancing weights.

19. The improvement claimed in claim 18, wherein said constant speed electric motor is mounted on a spring loaded support that maintains the distance between said motor and said unbalancing weights contsant as said motor rotates said unbalancing weights.

20. The improvement claimed in claim 19, wherein said unbalancing weights are tuned to one another.

21. The improvement claimed in claim 20, wherein said slot is defined by a pair of spaced-apart rods and including at least one bearing mounted on said journal and positioned to ride on said rods.

22. The improvement claimed in claim 21, wherein said rods are offset from one another and including two bearings mounted on said journal, one bearing positioned to ride on each of said rods.

23. The improvement claimed in claim 18, wherein said unbalancing weights include equally sized and configured gears that are coupled together.

24. The improvement claimed in claim 23, wherein said gears are formed of an elastomeric material and the teeth of said gears engage one another.

25. The improvement claimed in claim 24, wherein said gears are secured to said carriage such that the line running between the axes of rotation of said gears is horizontal and the carriage drive force axis is horizontal.

26. In a dot matrix line printer wherein a series of dot printing mechanisms are mounted side by side on an elongate carriage supported by flexrues attached to the frame of said printer for reciprocating movement along a print line defined by said dot printing mechanisms, the improvement comprising a shock stabilized, twin counterweight shuttle drive, said shock stabilized, twin counterweight shuttle drive including:

a pair of equally sized and configured unbalancing weights rotatably coupled together and secured to said carriage so as to be entirely supported by said carriage, said unbalancing weights being positioned such that the rotation of said unbalancing weights in opposite directions creates a drive force that reciprocably shuttles said carriage along said print line, said unbalancing weights also being positioned such that: (i) said drive force is aligned with the center of gravity of the carriage and the dot printing and any other mechanisms mounted on the carriage; and, (ii) the centers of rotation of the unbalancing weights lie along a line that is perpendicular to said print line;

rotation means coupled to said pair of equally sized and configured unbalancing weights for rotating said pair of equally sized and configured unbalancing weights in opposite directions; and, shock stabilizing means for stabilizing the shuttle motion of said carriage by coupling at least one of said unbalancing weights to the frame of said printer, said shock stabilizing means comprising a coupling that couples a coupling point spaced from the axis of rotation of said at least one of said unbalancing weights by a predetermined distance and located along a line running between the axis of rotation of said at least one unbalancing weight and the center of gravity of said at least one unbalancing weight to said supporting structure such that said coupling point can move perpendicularly, but not parallel, to the line of shuttle motion as said at least one unbalancing weight is rotated.

27. The improvement claimed in claim 26, wherein said predetermined distance determines the peak-to-peak shuttle motion of said carriage.

28. The improvement claimed in claim 27, wherein said coupling is formed by an arm lying generally parallel to the line of shuttle motion, one end of said arm being affixed to said supporting structure and the other end of said arm being rotatably connected to said one of said unbalancing weights at said coupling point that is spaced from the axis of rotation of said at least one weight by said peak-to-peak determining distance and located along a line running between the axis of rotation of said at least one unbalancing weight and the center of gravity of said at least one unbalancing weight.

29. The improvement claimed in claim 28, wherein said unbalancing weights are coupled together and wherein said rotation means comprises a constant speed electric motor coupled to said unbalancing weights for rotating said unbalancing weights.

30. The improvement claimed in claim 29, wherein said unbalancing weights include equally sized and configured gears that are coupled together.

31. The improvment claimed in claim 30, wherein said gears are formed of an elastomeric material and the teeth of said gears engage one another.

32. The improvement claimed in claim 31, wherein said gears are secured to said carriage such that the line running between the axes of rotation of said gears is vertical and the carriage drive force axis is horizontal.

* * * * *

UNITED STATES PATENT AND TRADEMARK OFFICE

CERTIFICATE OF CORRECTION

PATENT NO. : 4,764,040

DATED : August 16, 1988

INVENTOR(S) : C. Gordon Whitaker

It is certified that error appears in the above-identified patent and that said Letters Patent is hereby corrected as shown below:

Column 13, line 8, (Claim 3, line 8), insert --associated-- before with

Column 13, line 26, (Claim 5, line 5), "ad" should be --an--.

Column 15, line 39, (Claim 26, line 3), "flexrues" should be --flexures--.

Title page, under "OTHER PUBLICATIONS", --Advanced Dynamics, Shigley, pp. 48, 49, 82-85--, should be added.

Signed and Sealed this

Twenty-fourth Day of January, 1989

*Attest:*

DONALD J. QUIGG

*Attesting Officer*

*Commissioner of Patents and Trademarks*